United States Patent [19]
Roberts
[11] 4,090,458
[45] May 23, 1978

[54] PRESSURE RESPONSIVE FLUID BAG EJECTOR

[75] Inventor: Paul C. Roberts, Pasadena, Calif.

[73] Assignee: The United States of America as represented by the Secretary of the Navy, Washington, D.C.

[21] Appl. No.: 43,256

[22] Filed: Apr. 27, 1970

[51] Int. Cl.[2] ..... F42B 19/00; F42B 19/02
[52] U.S. Cl. ..... 114/20 R
[58] Field of Search ..... 114/20

[56] References Cited

U.S. PATENT DOCUMENTS 2,777,455 1/1957 Daudelin ..... 137/68
3,435,796 1/1969 Merrill ..... 114/20 X

*Primary Examiner*—Samuel Feinberg
*Assistant Examiner*—Thomas H. Webb
*Attorney, Agent, or Firm*—Richard S. Sciascia; Ervin F. Johnston

[57] ABSTRACT

A pressure responsive fluid bag ejector including an elongated flexible bladder means which is capable of containing a fluid and which has an outlet end for expelling the fluid; and the bladder being progressively structurally stronger toward its outlet end so that upon application of the pressure the bladder will progressively eject the fluid toward the outlet.

10 Claims, 11 Drawing Figures

FIG. 1.
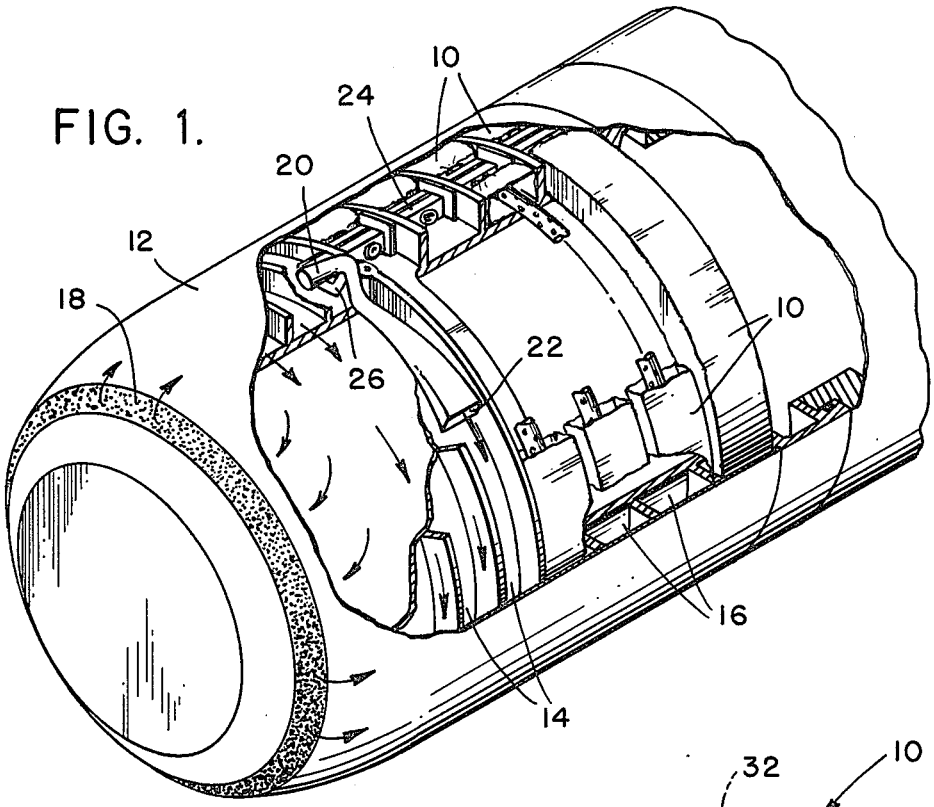
FIG. 2.
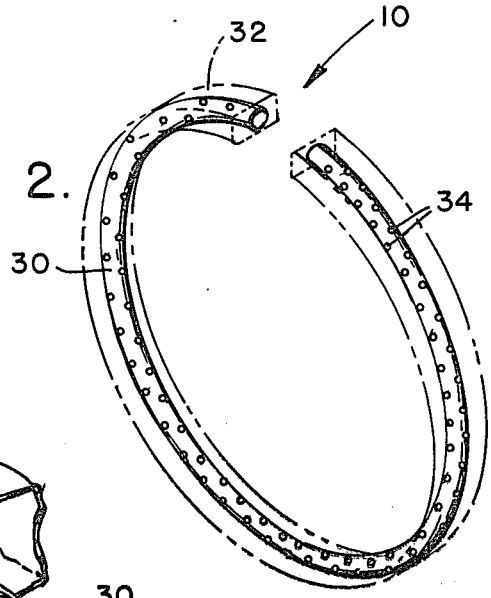
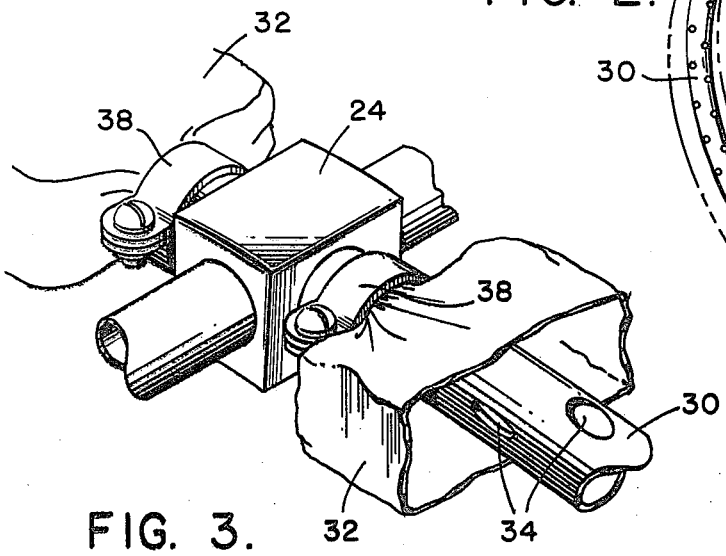
FIG. 3.

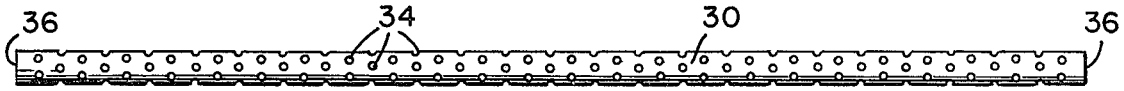
FIG. 4.
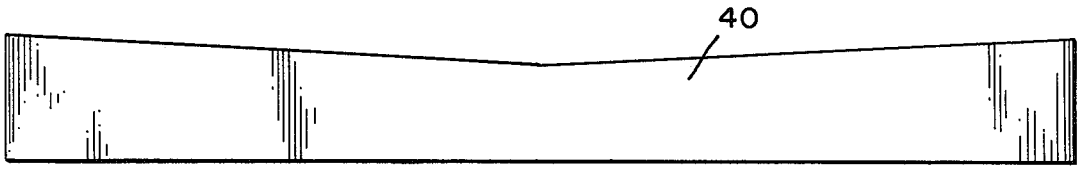
FIG. 5.
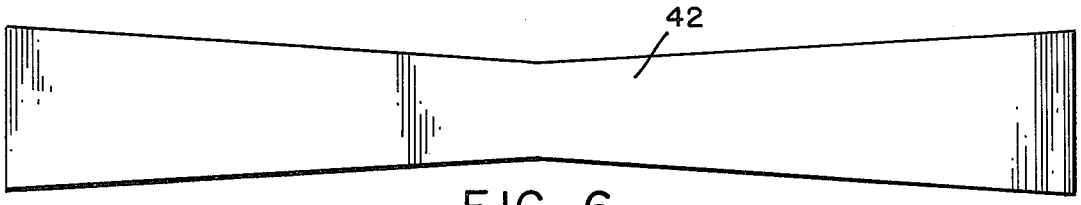
FIG. 6.
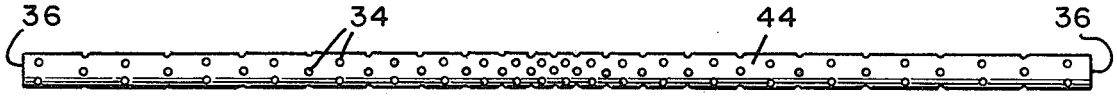
FIG. 7.
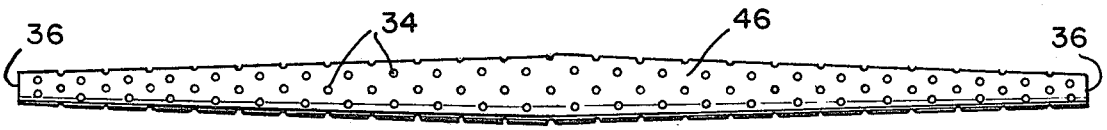
FIG. 8.
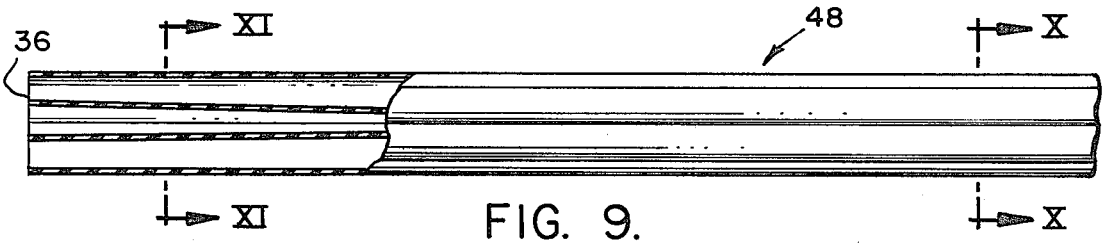
FIG. 9.
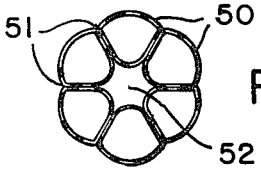
FIG. 11.
FIG. 10.
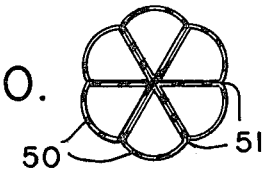

PRESSURE RESPONSIVE FLUID BAG EJECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

In order to reduce skin friction losses of a torpedo as it moves through the water it has been found desirable to expel a polymer solution from the nose of the torpedo within the boundary layer thereof. One approach of providing a supply of the polymer solution within the torpedo has been to store the polymer solution in annular compartments between the skin and the hull of the torpedo. Within each compartment it has been proposed to dispose a bag for containing the polymer slurry and a slender bladder or tube within the bag for feeding the polymer slurry to a manifold as exterior pressure is applied to the bag. A serious problem with this approach has been that the bladders within the bags pinch off on themselves so as to restrict the flow of the polymer slurry to the manifold before all of the slurry is squeezed out of the bladder. When this occurs the bag around the bladder is only partially emptied and the system for all practical purposes has been rendered inoperative.

SUMMARY OF THE INVENTION

The present invention has overcome the aforementioned problem by constructing the bladder progressively structurally stronger toward its outlet end so that upon application of pressure the bladder will progressively eject the polymer solution toward the outlet. This structural strength progression may be attained by making the wall of the bladder progressively structurally stronger toward the outlet by various means as described in the preferred embodiments.

STATEMENT OF THE OBJECTS OF THE INVENTION

An object of the present invention is to prevent the restriction of ejected fluid from a pressure responsive bladder as the fluid moves toward the bladder outlet.

Another object is to provide a long slender bladder for tank expulsion which will not collapse over the outlet or pinch off on itself and restrict the flow of fluid therefrom prior to substantially all of the fluid being squeezed out of the bladder.

A further object is to provide a bladder and bag combination for pressure expulsion of a fluid therein without the bladder pinching off on itself and restricting the flow of fluid before all of the fluid is squeezed out of the bladder.

Other objects and many of the attendant advantages of this invention will be readily appreciated as it becomes better understood by reference to the description and accompanying drawings which follow.

BRIEF DESCRIPTION OF THE DRAWINGS

FIG. 1 is an isometric illustration of the nose of a torpedo with portions cut away to show the mounting of the invention within the torpedo;

FIG. 2 is an isometric view of one of the bag-bladder fluid ejectors removed from the nose of the torpedo;

FIG. 3 is an isometric view of the connection of one end of the bladder and bag to the torpedo manifold;

FIG. 4 is a side view of a long slender tubular bladder which forms part of the fluid ejector;

FIG. 5 is a plan view of a cut of flexible material which can be used in constructing the tubular bladder;

FIG. 6 is a plan view of a cut of flexible material which can be used for constructing the tubular bladder;

FIG. 7 is a side view of another embodiment of the tubular bladder;

FIG. 8 is a side view of still another embodiment of the tubular bladder;

FIG. 9 is a side view of still a further embodiment of the tubular bladder; and FIG. 10 is a view taken along plane X—X of FIG. 9; and FIG. 11 is a cross-sectional view taken along plane XI—XI of FIG. 9.

DESCRIPTION OF THE PREFERRED EMBODIMENTS

Referring now to the drawings wherein like reference numerals designate like or similar parts throughout the several views there is shown in FIG. 1 the nose of a torpedo in which bag-bladder combinations 10 can be mounted for storing and ejecting polymer solution over the exterior surface of the torpedo. As illustrated in FIG. 1 a forward portion of the pressure hull of the torpedo has a reduced cross section and a fairing or skin 12 is mounted about the reduced pressure hull so as to form forward and after compartments 14 and 16 respectively. The bag-bladder combinations 10 are disposed within the after compartments 16 for storing a polymer slurry, and the forward compartment 14, which spirals about the torpedo, hydrates the polymer slurry with the water prior to ejection from an ejection strip 18 about the nose of the torpedo. A scoop 20 is mounted on the exterior of the torpedo between the forward and aft compartments 14 and 16 and has an outlet 22 into the forward compartment 14 so as to be capable of scooping water into the forward compartment as the torpedo moves through the water.

The scoop action causes a pressure in compartment 14 and this pressurized water slurry mix is allowed to pass under the skin 12 to pressurize the bag-bladder combinations 10 in compartment 16.

Extending transverse the compartments 16 is a manifold 24 which receives polymer slurry from the bag-bladder combinations 10 and feeds the slurry to the throat of the scoop 20 by a conduit 26. When the polymer slurry is introduced into the throat of the scoop 20 it is mixed with water which is ingested by the scoop and the mixture of water and polymer slurry is introduced into the forward compartment 14 through the scoop outlet 22. When this polymer mixture is ejected by the strip 18 over the exterior surface of the torpedo skin friction losses are reduced and the speed and range of the torpedo are increased.

In FIG. 2 one of the bag-bladder combinations 10 is shown removed from one of the after compartments 16 of the torpedo. In this embodiment the bladder, which may be a long slender flexible tube 30, is disposed within a long slender flexible bag 32. The tube 30 and bag 32 may both be constructed of polyurethane or rubber. The polymer slurry is stored within the bag 32 and a plurality of apertures 34 are provided in the tube 30 so that when the bag 32 is pressure squeezed the polymer slurry is introduced into the tube 30 through the apertures 34 and forced from the tubular outlets 36 into the manifold 24. As illustrated in FIG. 3 the bag and tube ends may be connected to the manifold by an ordinary hose clamp 38.

In accordance with the present invention the slender bladder or tube 30 is constructed in a novel manner so that when exterior fluid pressure is exerted on the bag-bladder combination the tube 30 will not pinch off on itself and thereby restrict expulsion of all of the polymer slurry from the bag-bladder combination 10. FIG. 4 illustrates the slender tube 30 in a straightened configuration. This tube is progressively structurally stronger from its center toward each of its outlets 36 so that upon application of pressure the tube will progressively eject the polymer slurry toward the respective outlets. In this embodiment of the tube the structural strength progression is attained by making the wall of the tube progressively structurally stronger from its center towards each outlet 36. This may be accomplished by making the tube 30 from a flat piece of flexible material 40, as illustrated in FIG. 5, or a flat piece of flexible material, as illustrated in FIG. 6. The material 40 is straight on one side and on its other side diverges from its center to maximum widths at its ends. Both sides of the material 42 diverge from its center to maximum widths at its ends. When either of the pieces of material 40 or 42 are rolled and bonded, such as by an epoxy, the configuration as shown in FIG. 4 is attained and the structural strength of the tube progressively becomes stronger from its center towards its outlets 36. In this manner a pressure applied uniformly along the length of the tube 30 will cause the tube to progressively collapse from its center towards its outlet ends 36 so that the tube will not become restricted prior to complete expulsion of all the fluid contained therein.

FIG. 7 illustrates a tube 44, which is another embodiment of the present invention. The tube 44 has a uniform wall thickness from end to end, however the apertures 34 decrease in number from its center towards its outlet ends 36. In this manner the wall of the tube 44 is weakest at its center and will collapse under pressure at this area first so as to progressively expel the fluid from the tube toward its outlet ends 36.

FIG. 8 is a tube 46 which illustrates a still further embodiment of the present invention. This tube has a uniform number of apertures 34 and a uniform wall thickness, however, its diameter is a maximum at its center and the tube diameter progressively decreases from the center toward the outlet ends 36. With such a construction the tube 46 is structurally weaker at its center and will collapse under pressure at this area first and then progressively collapse toward the outlet ends 36 to ensure complete expulsion of the fluid contained therein.

In FIG. 9 there is illustrated a tube 48 which is still another embodiment of the invention. In this embodiment the tube 48 includes a plurality of elongated bladders or tubes 50 which are progressively tapered with decreasing cross section (inflatable area) from their centers to their respective outlet ends 36. The bladders 50 may be connected by any suitable means, such as seam welding along edges 51, in an adjacent generally parallel relationship to form an inner elongated fluid containing chamber 52. The bladders or tubes 50, upon inflation, progressively diminish in chamber cross section from the center of the tube 48 toward the outlets 36. Upon the introduction of a pressure within the tubes 50 the center of the tube 48 will be the first area to become constricted, as illustrated in FIG. 10, and this constriction will progressively extend from the center toward the outlet ends 36 to ensure complete expulsion of the fluid from the tube 48.

OPERATION OF THE INVENTION

In the operation of the invention each bag-bladder combination 10 is filled with a polymer slurry and is connected, as shown in FIG. 3, to the manifold 24. When the torpedo commences to operate in the water, pressure is exerted from the forward compartment 14 under the torpedo skin 12 on the bag-bladder combinations 10 in the after compartments 16. Slurry from each bag is introduced through the apertures 34 in the bladder or tube until the bag is substantially depleted. The pressure then collapses the center of the tube first and this collapse progresses from the center toward the outlet ends 36 of the tube so as to ensure complete expulsion of the polymer slurry therefrom. The polymer slurry is fed by the manifold 24 into the scoop 20 where it is mixed with water, and then the mixture is introduced into the forward compartment 14. From the forward compartment the polymer mixture is expelled through the ejector strip 18 over the exterior surface of the torpedo to reduce skin friction thereon.

If desired the bag-bladder combination 10 may be provided with only one outlet which is connected to the manifold 24. In such an arrangement the tubes within the bags would be structurally weaker from one end to the other rather than from the center toward each respective end. Still another arrangement would be to connect and communicate the centers of the bag-bladder combinations 10 with a manifold. In such an arrangement the bags would be closed at their ends and their tubes would be structurally weakest at their ends and would progressively become stronger towards their centers.

Obviously many modifications and variations of the present invention are possible in the light of the above teachings. It is therefore to be understood that within the scope of the appended claims the invention may be practiced otherwise than as specifically described.

I claim:

1. In a fluid ejector which is responsive to pressure comprising:

elongated flexible bladder means which is capable of containing a fluid and which has an outlet end for expelling said fluid;

said bladder being progressively structurally stronger toward its outlet end throughout substantially the entire length of the bladder so that upon application of exterior fluid pressure the bladder will progressively eject the interior fluid toward said outlet without pinching off on itself.

2. A combination as claimed in claim 1 comprising:

the wall of the bladder having a plurality of apertures, and the structural strength progression being attained by the wall of the bladder being progressively structurally stronger toward said outlet.

3. A combination as claimed in claim 2 comprising:

the structural strength progression being attained by the apertures in the bladder wall decreasing in number toward said outlet.

4. A combination as claimed in claim 2 comprising:

the structural strength progression being attained by the cross-section of the bladder wall increasing in area toward said outlet.

5. A combination as claimed in claim 1 comprising:

the bladder means including a plurality of elongated tapered bladders which are connected in an adjacent generally parallel relationship to form an inner elongated fluid containing chamber.

6. A combination as claimed in claim 1 comprising:

an elongated flexible bag; and said bladder means being disposed in the bag with the longitudinal axes of the bladder and bag being substantially coextensive.

7. A combination as claimed in claim 6 comprising:

the bladder being open at opposite ends to form a pair of outlets; and means for connecting the open ends of the bladder to respective conduits.

8. A combination as claimed in claim 7 comprising:

the structural strength progression being attained by the cross-section of the bladder wall increasing in area toward each outlet.

9. A combination as claimed in claim 8 comprising:

the structural strength progression being attained by perforations in the wall of the bladder which decrease in number toward each outlet.

10. A combination as claimed in claim 9 comprising:

said bladder and the bag both being constructed of polyethylene.

* * * * *